US009558905B2

(12) United States Patent
Arce et al.

(10) Patent No.: US 9,558,905 B2
(45) **Date of Patent: *Jan. 31, 2017**

(54) FUSE WITH INSULATED PLUGS

(71) Applicant: Littelfuse, Inc., Chicago, IL (US)

(72) Inventors: Dennis Arce, Paranagul (PH); Simon Jude Burgos, Iligan (PH); Marlon Daza, Laguna (PH); Restituto Dumaran, Sto. Tomas (PH); Conrado de Leon, Manilla (PH); Merjaycel Marquinez, Batangas (PH); Dan Onken, Chatham, IL (US); Janus Pagharion, Paranaque (PH); Roel Retardo, Batangas (PH); Bienvenido Salonga, Batangas (PH); Crispin Zulueta, Batangas (PH)

(73) Assignee: Littelfuse, Inc., Chicago, IL (US)

( * ) Notice: Subject to any disclaimer, the term of this patent is extended or adjusted under 35 U.S.C. 154(b) by 559 days.

This patent is subject to a terminal disclaimer.

(21) Appl. No.: 13/658,161

(22) Filed: Oct. 23, 2012

(65) Prior Publication Data

US 2013/0106565 A1 May 2, 2013

Related U.S. Application Data

(63) Continuation-in-part of application No. 13/282,638, filed on Oct. 27, 2011, now Pat. No. 9,202,656.
(Continued)

(51) Int. Cl.
*H01H 85/04* (2006.01)
*H01H 85/165* (2006.01)
(Continued)

(52) U.S. Cl.
CPC ..... *H01H 85/165* (2013.01); *H01H 69/02* (2013.01); *H01H 85/38* (2013.01); *H01H 2085/383* (2013.01); *Y10T 29/49107* (2015.01)

(58) Field of Classification Search
CPC ..... H01H 85/165; H01H 69/02; H01H 85/38; H01H 2085/383; Y10T 29/49107
(Continued)

(56) References Cited

U.S. PATENT DOCUMENTS 3,374,330 A 3/1968 Cameron
3,460,086 A * 8/1969 Fister ..... 337/202
(Continued)

FOREIGN PATENT DOCUMENTS

GB 2278743 A1 12/1994
JP 57204635 S 12/1982
(Continued)

OTHER PUBLICATIONS

International Search Report for PCT/US2012/61579, Dated Jan. 9, 2013.

*Primary Examiner* — Anatoly Vortman

(57) ABSTRACT

An improved fuse including a fuse body formed of an electrically insulative material. The fuse body defines a cavity which extends from a first end of the fuse body to a second end of the fuse body. A fusible element is disposed within the cavity and extends from a first end face of the first end of the fuse body to a second end face of the second end of the fuse body. Insulated plugs are disposed within the cavity at the first and second ends of the fuse body wherein the plugs adhere to an interior surface of the fuse body and form seals that close the internal cavity. The fuse may further include end terminations that are applied to the ends of the fuse body in electrical contact with the fusible element.

9 Claims, 13 Drawing Sheets

Related U.S. Application Data

(60) Provisional application No. 61/652,401, filed on May 29, 2012.

(51) Int. Cl.
*H01H 69/02* (2006.01)
*H01H 85/38* (2006.01)

(58) Field of Classification Search
USPC ..... 337/186, 187, 190, 205, 227, 228, 231,337/234, 236, 246, 248, 251–253
See application file for complete search history.

(56) References Cited

U.S. PATENT DOCUMENTS

| | | | | |
|---|---|---|---|---|
| 3,505,630 | A | 4/1970 | Merrill et al. | |
| 4,035,753 | A | 7/1977 | Reeder | |
| 4,237,440 | A | 12/1980 | Miyasaka et al. | |
| 4,540,969 | A | 9/1985 | Sugar | |
| 4,563,809 | A | 1/1986 | Reeder | |
| 4,656,453 | A | 4/1987 | Reeder | |
| 4,680,567 | A | 7/1987 | Edwards | |
| 4,703,299 | A | 10/1987 | Vermij | |
| 4,703,300 | A | 10/1987 | Gaia | |
| 4,873,506 | A | 10/1989 | Gurevich | |
| 4,918,420 | A * | 4/1990 | Sexton | 337/205 |
| 5,077,534 | A | 12/1991 | Douglass | |
| 5,150,093 | A | 9/1992 | Badihi et al. | |
| 5,166,656 | A | 11/1992 | Badihi et al. | |
| 5,198,792 | A | 3/1993 | Bacon et al. | |
| 5,214,406 | A | 5/1993 | Reese et al. | |
| 5,228,188 | A | 7/1993 | Badihi et al. | |
| 5,235,307 | A * | 8/1993 | Oh | 337/228 |
| 5,262,750 | A | 11/1993 | Gurevich | |
| 5,296,833 | A | 3/1994 | Breen et al. | |
| 5,432,378 | A | 7/1995 | Whitney et al. | |
| 5,552,757 | A | 9/1996 | Blecha et al. | |
| 5,617,069 | A | 4/1997 | Arikawa et al. | |
| 5,664,320 | A | 9/1997 | Gurevich | |
| 5,812,046 | A | 9/1998 | Brown et al. | |
| 6,507,265 | B1 | 1/2003 | Ackermann | |
| 6,778,061 | B2 | 8/2004 | Nakano et al. | |
| 6,798,330 | B2 | 9/2004 | Arikawa et al. | |
| 7,138,899 | B2 | 11/2006 | Jollenbeck et al. | |
| 7,250,843 | B2 * | 7/2007 | Richter et al. | 337/250 |
| 8,368,502 | B2 | 2/2013 | Washizaki et al. | |
| 2005/0057337 | A1 | 3/2005 | Richter et al. | |
| 2007/0019351 | A1 | 1/2007 | Witney et al. | |
| 2009/0309689 | A1 | 12/2009 | Pavlovic et al. | |

FOREIGN PATENT DOCUMENTS

| | | | |
|---|---|---|---|
| JP | 61200640 | S | 9/1986 |
| JP | 62131431 | S | 6/1987 |
| JP | 07192593 | H | 7/1995 |
| JP | 08106845 | H | 4/1996 |
| JP | 08222117 | H | 8/1996 |
| JP | 10177835 | H | 6/1998 |
| JP | 11204004 | H | 7/1999 |
| JP | 2002100272 | A | 4/2002 |
| JP | 2003123609 | A | 4/2003 |
| JP | 2006164979 | A | 6/2006 |
| JP | 2010015715 | A | 1/2010 |
| JP | 2011508407 | A | 3/2011 |
| WO | 9114279 | A1 | 9/1991 |

* cited by examiner

FUSE WITH INSULATED PLUGS

FIELD OF THE DISCLOSURE

Embodiments of the invention relate to the field of circuit protection devices. More particularly, the present invention relates to a fuse having insulated plugs that seal a cavity formed within a fuse body and help to extinguish electrical arcs when an overcurrent condition occurs.

BACKGROUND OF THE DISCLOSURE

Fuses are used as circuit protection devices and form an electrical connection with a component in a circuit to be protected. One type of fuse includes a fusible element disposed within a hollow fuse body. Upon the occurrence of a specified fault condition, such as an overcurrent condition, the fusible element melts or otherwise opens to interrupt the circuit path and isolate the protected electrical components or circuit from potential damage. Such fuses may be characterized by the amount of time required to respond to an overcurrent condition. In particular, fuses that comprise different fusible elements respond with different operating times since different fusible elements can accommodate varying amounts of current through the fusible element. Thus, by varying the size and type of fusible element, different operating times may be achieved.

When an overcurrent condition occurs, an arc may be formed between the melted portions of the fusible element. If not extinguished, this arc may further damage the circuit to be protected by allowing unwanted current to flow to circuit components. Thus, it is desirable to manufacture fuses which extinguish this arc as quickly as possible. In addition, as fuses decrease in size to accommodate ever smaller electrical circuits, there is a need to reduce manufacturing costs of these fuses. This may include reducing the number of components and/or using less expensive components, as well as reducing the number and/or complexity of associated manufacturing steps.

Consequently, there is a need to reduce the number of components and/or manufacturing steps to produce a fuse with improved arc extinguishing characteristics. It is with respect to these and other considerations that the present improvements have been needed.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Various embodiments are generally directed to a fuse having a fuse body formed of an electrically insulative material. The fuse body defines a cavity which extends from a first end of the fuse body to a second end of the fuse body. A fusible element is disposed within the cavity and extends from a first end face of the first end of the fuse body to a second end face of the second end of the fuse body. Insulated plugs are disposed within the cavity at the first and second ends wherein the plugs form seals that close the internal cavity. Other embodiments of the fuse are described and claimed herein A method for forming a fuse in accordance with the present disclosure may thus include the steps of threading a fusible element through a cavity of a fuse body with ends of the fusible element being disposed on end faces at respective ends of the fuse body. Insulative adhesive may be deposited within the cavity proximate the ends of the fuse body, wherein the insulative adhesive adheres to an interior surface of the fuse body and seals the cavity. Other embodiments of the method are described and claimed herein

BRIEF DESCRIPTION OF THE DRAWINGS

By way of example, specific embodiments of the disclosed device will now be described, with reference to the accompanying drawings, in which.

DETAILED DESCRIPTION

Figure 1A:
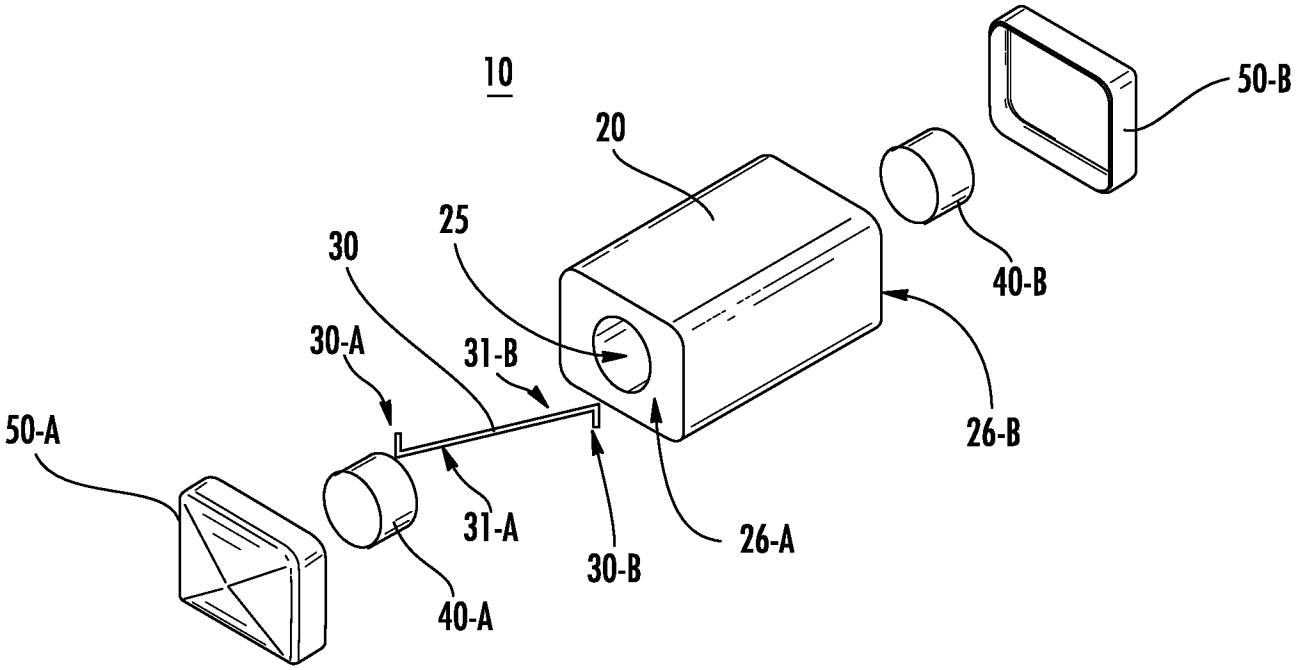
FIG. 1A illustrates a perspective exploded view of an exemplary fuse in accordance with the present disclosure.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1A illustrates a perspective exploded view of an exemplary fuse 10 in accordance with the present disclosure.

The fuse 10 includes a fuse body 20 which defines a cavity 25 extending from a first end face 26-A to a second end face 26-B. The shape of the fuse body 20 can be, for example, rectangular, cylindrical, triangular, etc., with various cross-sectional configurations. The fuse body 20 may be formed from an electrically insulative material such as, for example, glass, ceramic, plastic, etc.

The fuse 10 includes a fusible element 30 that is disposed within the cavity 25 and extends in a diagonal orientation from the first end face 26-A of the fuse body 20 to the second end face 26-B. In particular, the fusible element 30 has a first end 30-A which is bent or otherwise made contiguous with the respective end face 26-A of the fuse body 20 and a second end 30-B which is also bent or otherwise made contiguous with the respective end face 26-B of the fuse body 20. The fusible element 30 is configured to melt or otherwise create an open circuit under certain overcurrent conditions. The fusible element 30 may be a ribbon, a wire, a metal link, a spiral wound wire, a film, an electrically conductive core deposited on a substrate, or may have any other suitable structure or configuration for providing a circuit interrupt.

The fuse 10 also includes insulated plugs 40-A and 40-B which are disposed within the cavity 25 at respective longitudinal ends of the fuse body 20 to close or plug openings thereto. In particular, the insulated plugs 40-A and 40-B may be formed of an insulative adhesive material, such as ceramic adhesive, for example, that is deposited in the cavity 25 after the fusible element 30 is positioned within fuse body 20 during manufacture. In addition, the insulated plugs 40-A and 40-B may be positioned to allow the respective ends 30-A and 30-B of the fusible element 30 to be disposed at least partially between the plugs 40-A and 40-B and an interior surface of the fuse body 20. The ends 30-A and 30-B may thus extend to, and engage, the end faces 26-A and 26-B, respectively. In particular, a portion 31-A of the fusible element 30 that is proximate the first end 30-A is positioned between insulated plug 40-A and the interior surface of the fuse body 20 to allow the end 30-A of the fusible element 30 to protrude from the cavity 25 and engage the surface 26-A of the fuse body 20. Similarly, the portion 31-B of the fusible element 30 that is proximate the second end 30-B is positioned between the insulated plug 40-B and the interior surface of the fuse body 20 to allow the end 30-B of the fusible element 30 to protrude from the cavity 25 and engage the surface 26-B of the fuse body 20.

The fuse 10 includes first 50-A and second 50-B end terminations disposed on the first 26-A and second 26-B end faces, respectively, of the fuse body 20 which also cover the insulated plugs 40-A and 40-B. In particular, the first end termination 50-A is in electrical contact with at least the first end 30-A of the fusible element 30 at the end face 26-A and the second end termination 50-B is in electrical contact with at least the second end 30-B of the fusible element 30 at the end face 26-B. In this manner, a current path is defined between the end terminations 50-A and 50-B and the fusible element 30. The first and second end terminations 50-A and 50-B may be formed of an electrically conductive material, such as silver (Ag) paste or an electrolessly deposited metal such as copper (Cu), applied to the ends of the fuse body 20 over the insulated plugs 40-A and 40-B. The end terminations 50-A and 50-B may also be plated with nickel (Ni) and/or tin (Sn) to accommodate soldering of the fuse 10 to a circuit board or other electrical circuit connection.

Figure 1B:
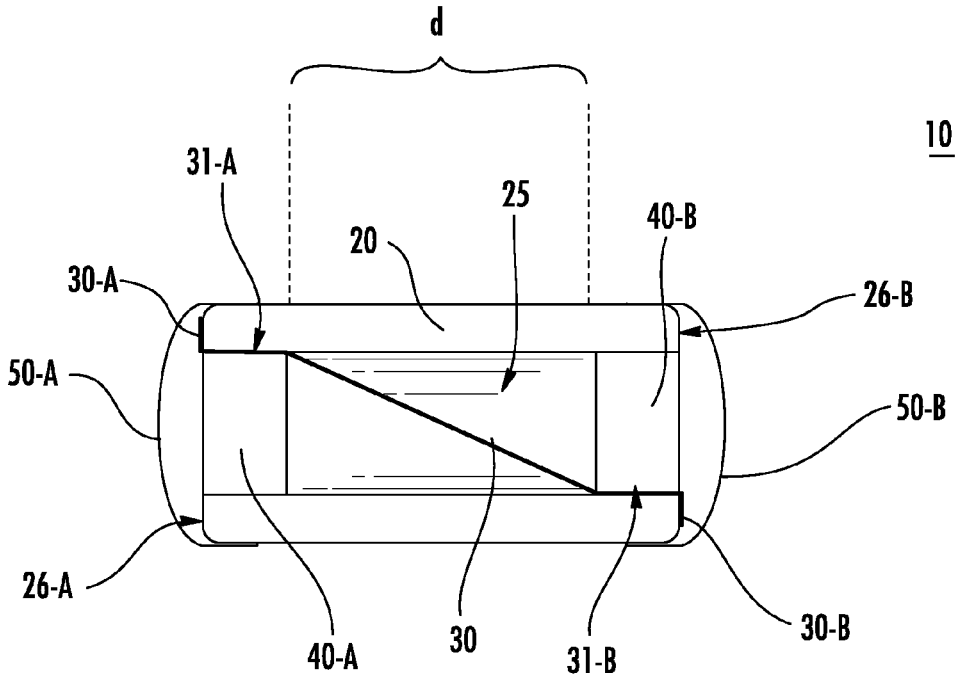
FIG. 1B illustrates a side cross sectional view of the fuse shown in FIG. 1A.

FIG. 1B illustrates a side cross sectional view of the assembled fuse 10. As can be seen, and as described above, the fusible element 30 is oriented diagonally within the cavity 25 of the fuse body 20 with the first end 30-A disposed on the end face 26-A, and with the second end 30-B disposed on the end face 26-B. The insulated plug 40-A is disposed within the cavity 25 with the portion 31-A of the fusible element 30 disposed between the plug 40-A and the interior surface of the fuse body 20. Similarly, the insulated plug 40-B is disposed within the cavity 25 with the portion 31-B of the fusible element 30 disposed between the plug 40-B and the interior surface of the fuse body 20.

When an overcurrent condition occurs, the fusible element 30 melts, which interrupts the flow of current in the circuit (not shown) to which the fuse 10 is connected. When the fusible element 30 melts, an electric arc may form in a gap or arc channel that is created between the separated, un-melted portions of the fusible element 30 that remain within the cavity 25. The un-melted portions of the fusible element 30 continue to melt and recede from one another and the arc channel therebetween continues to grow until the voltage in the circuit is lower than that required to maintain the arc across the arc channel, at which point the arc is extinguished. The insulated plugs 40-A and 40-B serve to reduce this arc channel within the cavity 25 by decreasing the length "d" of the cavity 25 defined between the insulated plugs 40-A and 40-B relative to conventional fuses having no such insulated plugs, as well as by providing insulated seals at the longitudinal ends of the fuse body 20 which facilitates the interruption of fault currents more quickly than conventional fuse configurations. In addition, it is contemplated that the insulated plugs 40-A and 40-B can be formed of ceramic adhesive or other insulative materials that do not possess gas evolving properties. Therefore, when an overcurrent condition occurs and an electrical arc is generated in the cavity 25, the insulated plugs 40-A and 40-B do not emit gas into the cavity 25 which could otherwise feed the arc.

The end termination 50-A is disposed over the end face 26-A of the fuse body 20, the end 30-A of fusible element 30, and the insulated plug 40-A. Similarly, the end termination 50-B is disposed over the end face 26-B of fuse body 20, the end 30-B of the fusible element 30, and the insulated plug 40-B. As described above, the end terminations 50-A and 50-B may be formed of silver paste that applied to the longitudinal ends of the fuse body 20. The insulated plugs 40-A and 40-B thus provide a surface for the end terminations 50-A and 50-B, respectively, to be deposited on. Otherwise, in the absence of the insulated plugs 40-A and 40-B, multiple applications of a layered paste, such as, for example, silver paste, would have to be successively deposited at the ends of the fuse body 20, with each layer being allowed to dry before a subsequent layer of paste is applied in order to ultimately close or seal the ends of cavity 25 before the end terminations 50-A and 50-B are fully disposed over the respective end faces 26-A and 26-B. Thus, the use of insulated plugs reduces manufacturing time and associated costs by providing an application surface for the end terminations 50-A and 50-B and thereby avoiding the need to apply multiple layers of paste to seal the cavity 25.

Figure 2A:
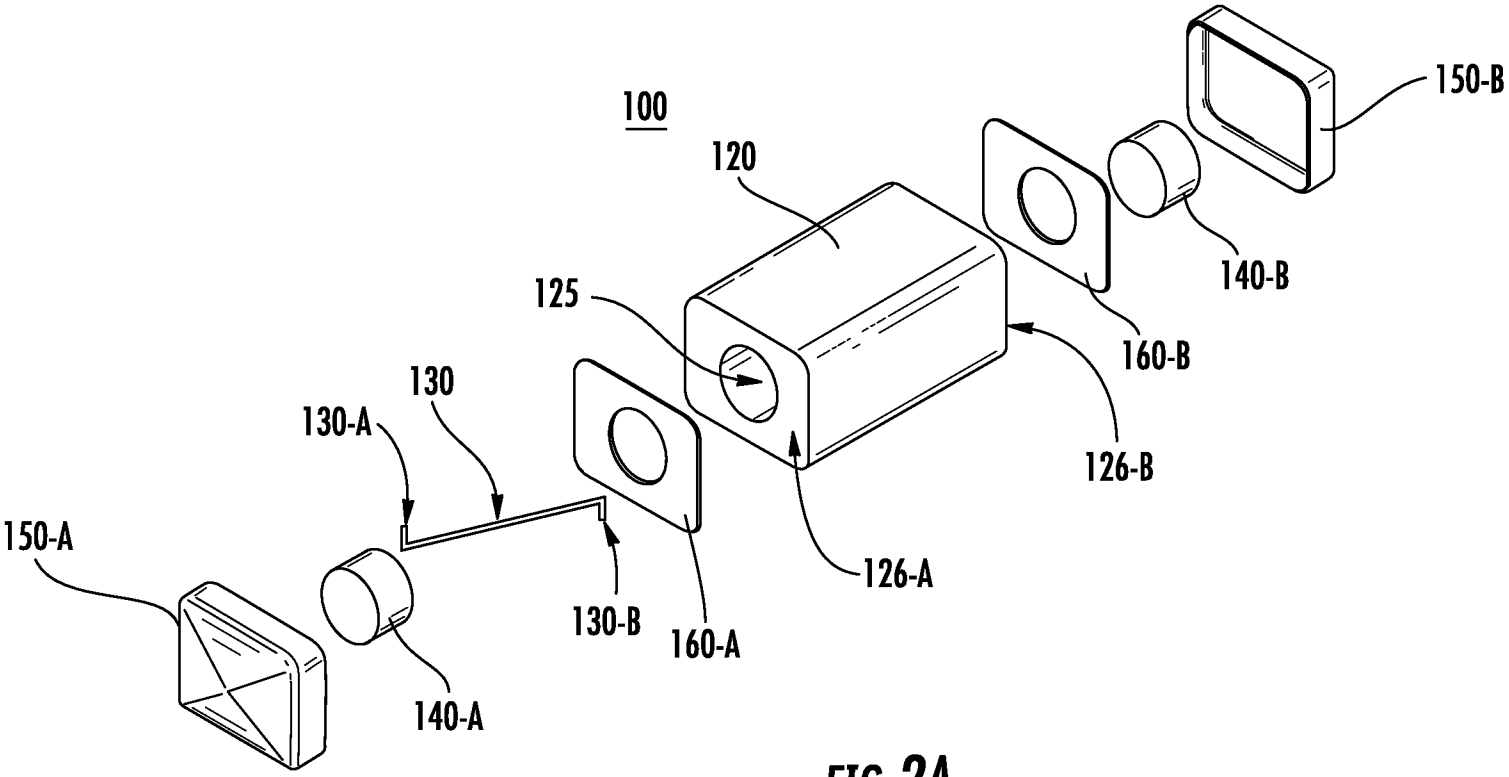
FIG. 2A illustrates a perspective exploded view of an alternative fuse embodiment in accordance with the present disclosure.

FIG. 2A illustrates an exploded perspective view of an exemplary embodiment of an alternative fuse 100 in accordance with the present disclosure. The fuse 100 includes a fuse body 120 which defines a cavity 125 extending from a first end face 126-A to a second end face 126-B. As described above with regard to the fuse 10, the fuse body 120 may be formed from an electrically insulative material such as, for example, glass, ceramic, plastic, etc.

A fusible element 130 is disposed within the cavity 125 and extends from the first end face 126-A of the fuse body 120 to the second end face 126-B. The fusible element 130 has a first end 130-A which is bent or otherwise made contiguous with the respective end face 126-A of the fuse body 120 and a second end 130-B which is also bent or otherwise made contiguous with the respective end face 126-B of the fuse body 120. The fusible element 130 may be a ribbon, a wire, a metal link, a spiral wound wire, a film, an electrically conductive core deposited on a substrate, or may have any other suitable structure or configuration for providing a circuit interrupt. The ends 130-A and 130-B of the fusible element 130 are shown as being spaced away from the respective end faces 126-A and 126-B, however, this configuration is shown only for explanatory purposes. Particularly, the ends 130-A and 130-B of the fusible element 130 are disposed on the respective end faces 126-A and 126-B of the fuse body 120 in a manner similar to the ends 30-A and 30-B described above. The fusible element 130 is configured to melt or otherwise create an open circuit under certain overcurrent conditions depending on the fuse rating.

A metalized coating 160-A is disposed on the end face 126-A of the fuse body 120 and is in electrical contact with the end 130-A of the fusible element 130. Similarly, a metalized coating 160-B is disposed on the end face 126-B of the fuse body 120 and is in electrical contact with the end 130-B of the fusible element 130. Notably, the metalized coatings 160-A and 160-B are not deposited on the interior surface of the fuse body 120. The metalized coatings 160-A and 160-B assist in forming electrical connections between the ends 130-A and 130-B of the fusible element 130 and the respective end terminations 150-A and 150-B as further described below.

Insulated plugs 140-A and 140-B are disposed within the cavity 125 at respective longitudinal ends of the fuse body 120. As described above with regard to the fuse 30, the insulated plugs 140-A and 140B may be formed of an insulative adhesive material, such as ceramic adhesive, that is deposited within the cavity 125 after the fusible element 130 is positioned within fuse body 120 with the ends 130-A and 130-B disposed on the respective end faces 126-A and 126-B. The insulated plugs 140-A and 140-B may be positioned to allow the respective ends 130-A and 130-B of the fusible element 130 to be disposed at least partially between the plugs 140-A and 140-B and an interior surface of the fuse body 120. The ends 130-A and 130-B may thus extend to, and engage, the end faces 126-A and 126-B, respectively. The metalized coatings 160-A and 160-B are applied to the end faces 126-A and 126-B as described above.

The fuse 100 includes first 150-A and second 150-B end terminations disposed on the first 126-A and second 126-B end faces of the fuse body 120 which also cover the respective insulated plugs 140-A and 140-B. In particular, the first end termination 150-A is in electrical contact with the end 130-A of the fusible element 130 and the metalized coating 160-A at the end face 126-A of the fuse body 120. Similarly, the second end termination 150-B is in electrical contact with the end 130-B of the fusible element 130 and the metalized coating 160-B at the end face 126-B of the fuse body 120. In this manner, a current path is defined between the end terminations 150-A and 150-B and the fusible element 130 via the metalized coatings 160-A and 160-B. The first and second end terminations 150-A and 150-B may be formed of an electrically conductive material, such as silver (Ag) paste or an electrolessly deposited metal such as copper (Cu), applied to the ends of the fuse body 120 over the insulated plugs 140-A and 140-B. The end terminations 150-A and 150-B may also be plated with nickel (Ni) and/or tin (Sn) to accommodate soldering of the fuse 100 to a circuit board or other electrical circuit connection.

Figure 2B:
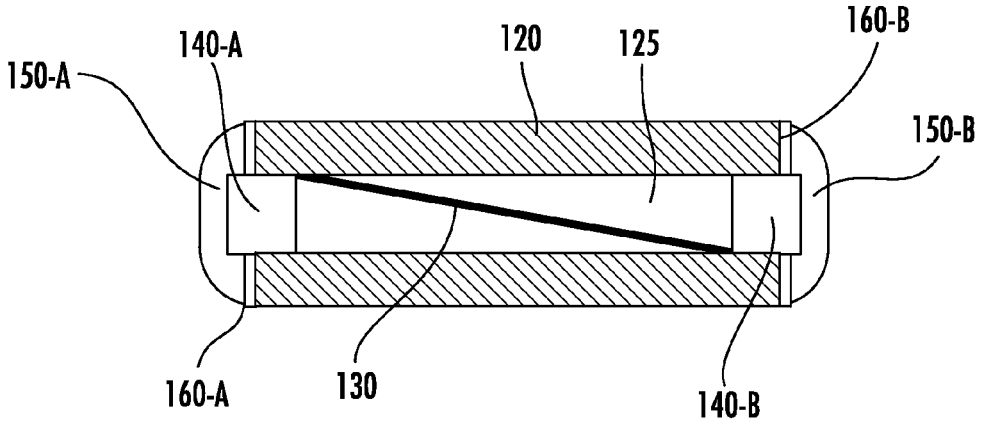
FIG. 2B illustrates a side cross sectional view of the fuse shown in FIG. 2A.

FIG. 2B illustrates a side cross sectional view of the assembled fuse 100 wherein the fusible element 130 is oriented diagonally within the cavity 125 of the fuse body 120 with the end 130-A disposed on end face 126-A and the end 130-B disposed on end face 126-B. As described above, the metalized coating 160-A is disposed on the face 126-A and forms an electrical connection between the end 130-A of the fusible element 130 and the end termination 150-A. Similarly, the metalized coating 160-B is disposed on the end face 126-B and forms an electrical connection between the end 130-B of the fusible element 130 and the end termination 150-B. The insulated plug 140-A is disposed within the cavity 125 which seals the cavity 125 from the end termination 150-A and the insulated plug 140-B is disposed within the cavity 125 which seals the cavity 125 from the end termination 150-B.

When an overcurrent condition occurs, the fusible element 130 melts which interrupts the circuit (not shown) to which the fuse 100 is connected. When the fusible element 130 melts, an electric arc may form in a gap or arc channel that is created between the separated, un-melted portions of the fusible element 130 that remain within the cavity 125. The un-melted portions of the fusible element 130 continue to melt and recede from one another and the arc channel therebetween continues to grow until the voltage in the circuit is lower than that required to maintain the arc across the arc channel, at which point the arc is extinguished. The insulated plugs 140-A and 140-B serve to reduce this arc channel within the cavity 125 by decreasing the length of the cavity 125 defined between the insulated plugs 140-A and 140-B relative to conventional fuses having no such insulated plugs, as well as by providing insulated seals at the longitudinal ends of the fuse body 120 which facilitates the interruption of fault currents more quickly than conventional fuse configurations. In addition, it is contemplated that the insulated plugs 140-A and 140-B can be formed of ceramic adhesive or other insulative materials that do not possess gas evolving properties. Therefore, when an overcurrent condition occurs and an electrical arc is generated in the cavity 125, the insulated plugs 140-A and 140-B do not emit gas into the cavity 125 which could otherwise feed the arc.

Included herein are flow chart(s) representative of exemplary methodologies for performing novel aspects of the present disclosure. While, for purposes of simplicity of explanation, the one or more methodologies shown herein, for example, in the form of a flow chart or logic flow, are shown and described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology could alternatively be represented as a series of interrelated states or events. Moreover, not all acts illustrated in a methodology may be required for a novel implementation.

Figure 3:
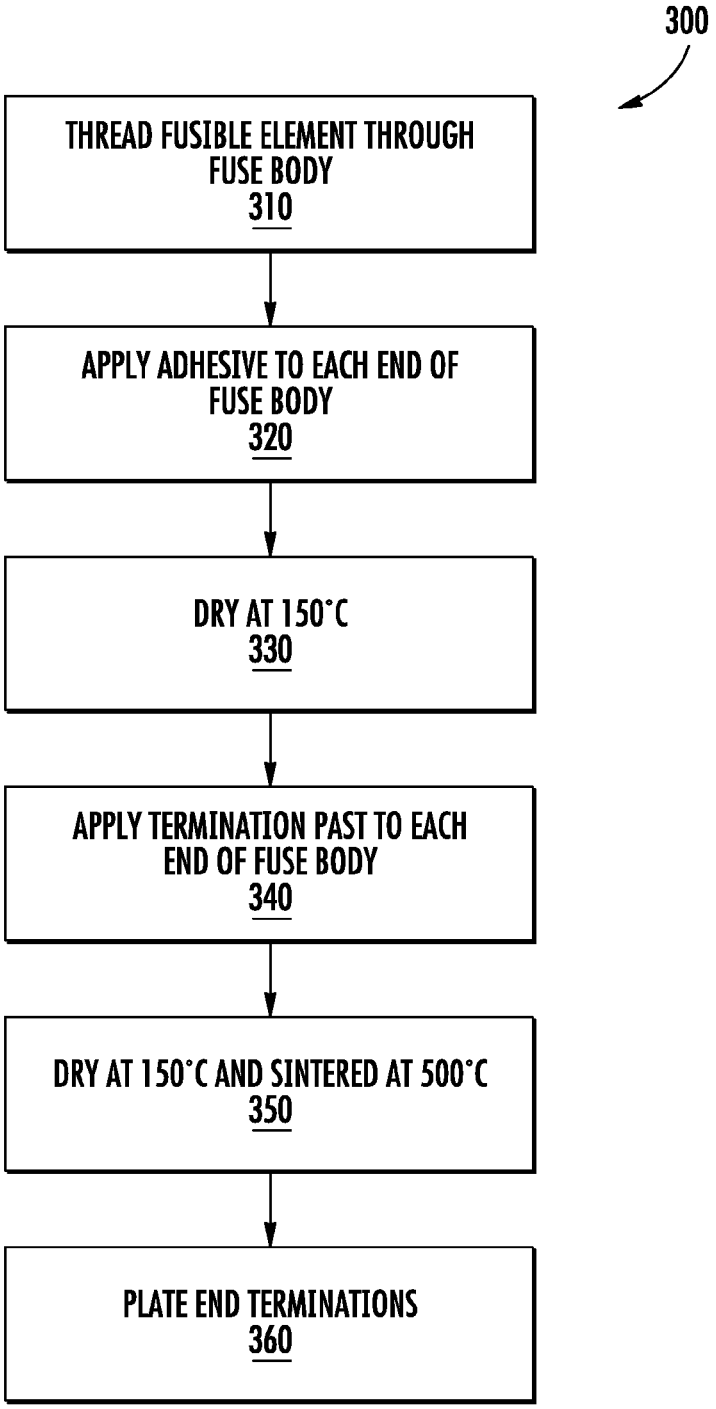
FIG. 3 illustrates a logic flow diagram in connection with the fuse shown in FIGS. 1A and 1B.

FIG. 3 illustrates an embodiment of a logic flow 300 in connection with the fuse 10 shown in FIGS. 1A and 1B. A fusible element 30 is threaded through the fuse body at step 310. For example, the fusible element 30 is threaded through the fuse body 20 with the ends 30-A and 30-B being disposed on the end faces 26-A and 26-B. A ceramic adhesive is deposited within the cavity 25 at the longitudinal ends of the fuse body 20 at step 320. The ceramic adhesive adheres to the interior surface of the fuse body 20 and serves to close or seal the ends of the cavity 25. The adhesive is dried at, for example, 150° C. for a predetermined time period at step 330. End terminations 50-A and 50-B, such as may be formed of a silver paste or an electrolessly deposited metal such as copper, are applied to each end of fuse body 20 at step 340. The end terminations 50-A and 50-B may be dried at 150° C. and sintered at 500° C. at step 350. The end terminations 50-A and 50-B may be plated with Nickel (Ni) and/or Tin (Sn) at step 360 to accommodate solderability of the fuse 10 to one or more electrical connections within a circuit.

Figure 4:
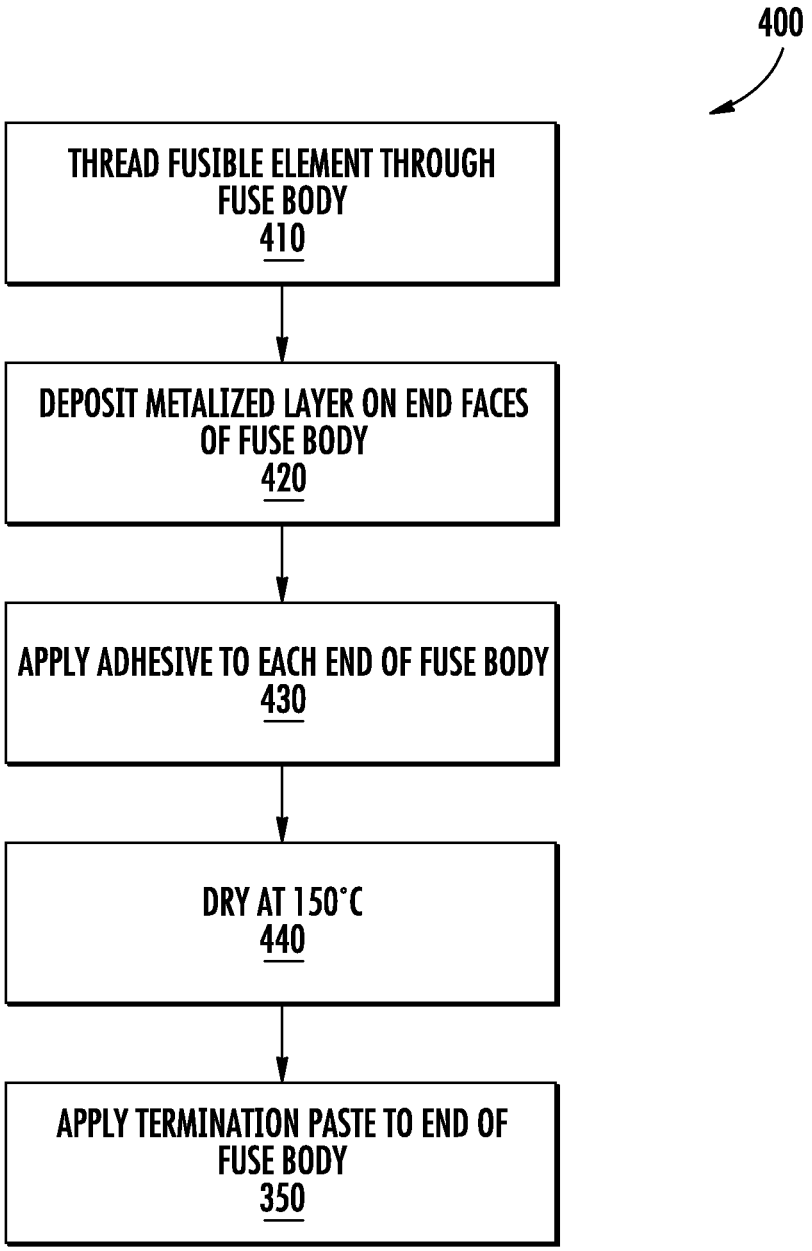
FIG. 4 illustrates a logic flow diagram in connection with the fuse shown in FIGS. 2A and 2B.

FIG. 4 illustrates an embodiment of a logic flow 400 in connection with the fuse 100 shown in FIGS. 2A and 2B. A fusible element 130 is threaded through the fuse body at step 410. For example, the fusible element 130 is threaded through the fuse body 120 with the ends 130-A and 130-B of the fusible element 130 being disposed on the end faces 126-A and 126-B. A metalized layer is deposited on the end faces 126-A and 126-B of the fuse body 120 at step 420. A ceramic adhesive is deposited within the cavity 125 at the longitudinal ends of the fuse body 120 at step 430. The ceramic adhesive adheres to the interior surface of the fuse body 120 and serves to close or seal the longitudinal ends of the cavity 125. The adhesive is dried at, for example, 150° C. for a predetermined time period at step 440. End terminations 150-A and 150-B, such as may be formed of silver paste or an electrolessly deposited metal such as copper, are applied to each end of the fuse body 120 at step 450.

Figure 5A:
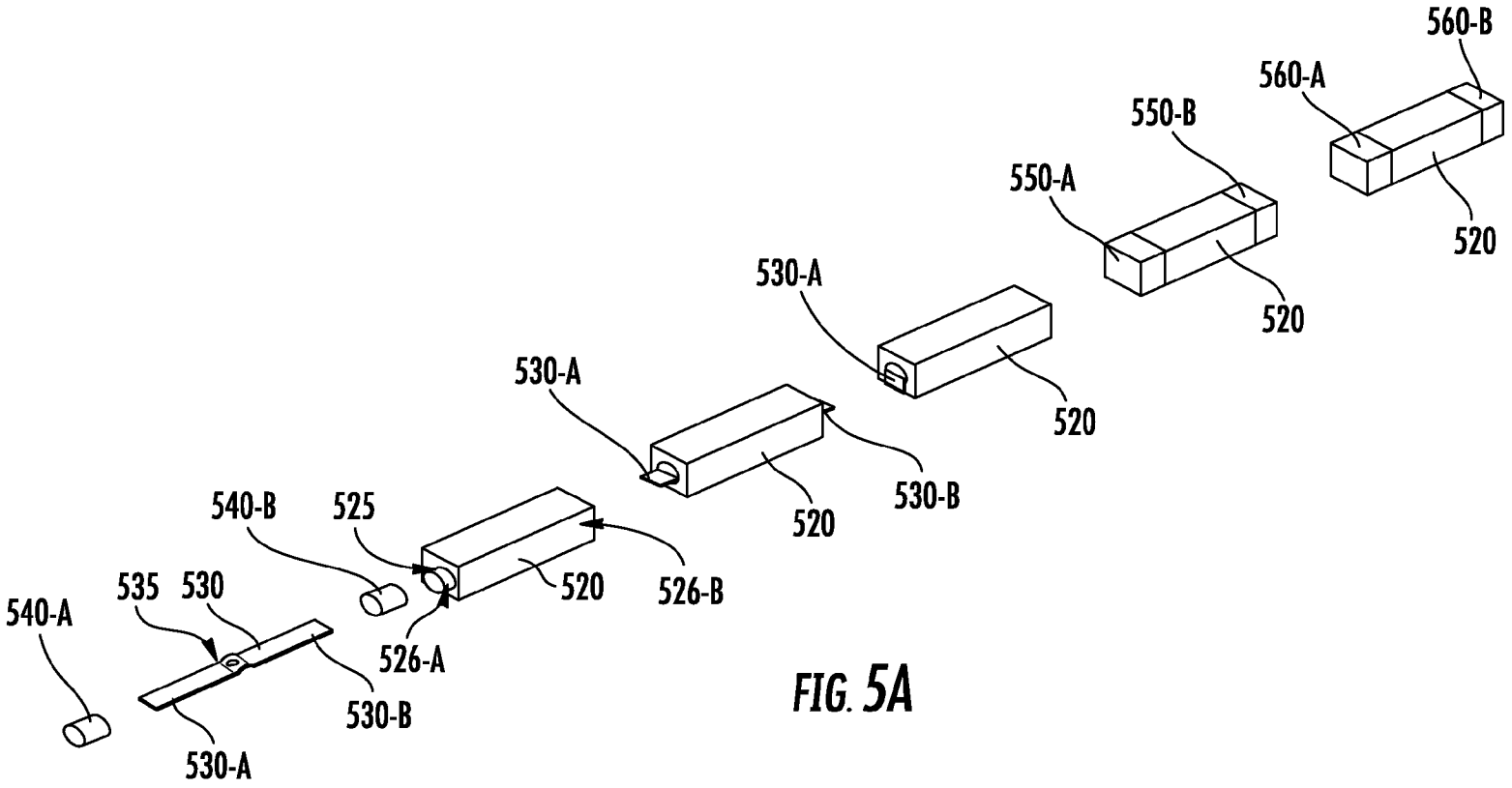
FIG. 5A illustrates a progression of perspective views depicting the formation of another alternative fuse embodiment in accordance with the present disclosure.

FIG. 5A illustrates an exploded perspective view of an exemplary embodiment of an alternative fuse 500 in accordance with the present disclosure. The fuse 500 includes a fuse body 520 which defines a cavity 525 extending from a first end face 526-A to a second end face 526-B. As described above with regard to the fuse 10, the fuse body 520 may be formed from an electrically insulative material such as, for example, glass, ceramic, plastic, etc.

A fusible element 530 is disposed within the cavity 525 and extends from the first end face 526-A of the fuse body 520 to the second end face 526-B. The fusible element 530 has a first end 530-A which is bent or otherwise made contiguous with the respective end face 526-A of the fuse body 520 and a second end 530-B which is also bent or otherwise made contiguous with the respective end face 526-B of the fuse body 520. The fusible element 530 may be a ribbon, a wire, a metal link, a spiral wound wire, a film, an electrically conductive core deposited on a substrate, or may have any other suitable structure or configuration for providing a circuit interrupt.

The fusible element 530 may include a center kink 535 which may also have one or more holes formed through it to serve as a weak connection area. The kinked portion 535, located generally at the center of the fusible element 530, provides a means for relieving stress, including both expansion and compression stresses, which may be produced in the fusible element 530 during a thermal cycle that could otherwise cause premature breakage of the element 530. The fusible element 530 is configured to melt or otherwise create an open circuit under certain overcurrent conditions depending on the fuse rating.

A metalized coating 560-A is disposed on the end face 526-A of the fuse body 520 and is in electrical contact with the end 530-A of the fusible element 530. Similarly, a metalized coating 560-B is disposed on the end face 526-B of the fuse body 520 and is in electrical contact with the end 530-B of the fusible element 530. Notably, the metalized coatings 560-A and 560-B are not deposited on the interior surface of the fuse body 520. The metalized coatings 560-A and 560-B assist in forming electrical connections between the ends 530-A and 530-B of the fusible element 530 and the respective end terminations 550-A and 550-B as further described below.

Insulated plugs 540-A and 540-B are disposed within the cavity 525 at respective longitudinal ends of the fuse body 520. As described above with regard to the fuse 530, the insulated plugs 540-A and 540B may be formed of an insulative adhesive material, such as ceramic adhesive, that is deposited within the cavity 525 after the fusible element 530 is positioned within the fuse body 520, with the ends 530-A and 530-B extending through the plugs 540-A and 540-B and disposed on the respective end faces 526-A and 526-B. Particularly, since the plug 540-A may be an adhesive applied to the cavity 525, the fusible element 530, positioned within the fuse body 520, is surrounded by the adhesive that comprises the plug 540-A. In this manner, the end 530-A of the fusible element 530 extends through the adhesive plug 540-A and also extends outside the fuse body 520. Similarly, since the plug 540-B may be made from an adhesive applied to the cavity 525, the fusible element 530, positioned within fuse body 520, is surrounded by the adhesive that comprises the plug 540-B. In this manner, the end 530-B of the fusible element 530 extends through the adhesive plug 540-B and also extends outside of the fuse body 520. Each of the ends 530-A and 530-B of the fusible element 530 may be bent or crimped along the respective end surfaces 526-A and 526-B of the fuse body 520 as described above. The metalized coatings 560-A and 560-B are then applied to the end faces 526-A and 526-B as described above.

The fuse 500 includes first 550-A and second 550-B end terminations disposed on the first 526-A and second 526-B end faces of fuse body 520 which also cover the respective insulated plugs 540-A and 540-B. In particular, the first end termination 550-A is in electrical contact with the end 530-A of the fusible element 530 and the metalized coating 560-A at the end face 526-A of the fuse body 520. Similarly, the second end termination 550-B is in electrical contact with the end 530-B of the fusible element 530 and the metalized coating 560-B at the end face 526-B of the fuse body 520. In this manner, a current path is defined between the end terminations 550-A and 550-B and the fusible element 530 via the metalized coatings 560-A and 560-B. The first and second end terminations 550-A and 550-B may be formed of an electrically conductive material, such as silver (Ag) paste or an electrolessly deposited metal such as copper (Cu), applied to the ends of the fuse body 520. The end terminations 550-A and 550-B may also be plated with nickel (Ni) and/or tin (Sn) to accommodate soldering of the fuse 500 to a circuit board or other electrical circuit connection.

Figure 5B:
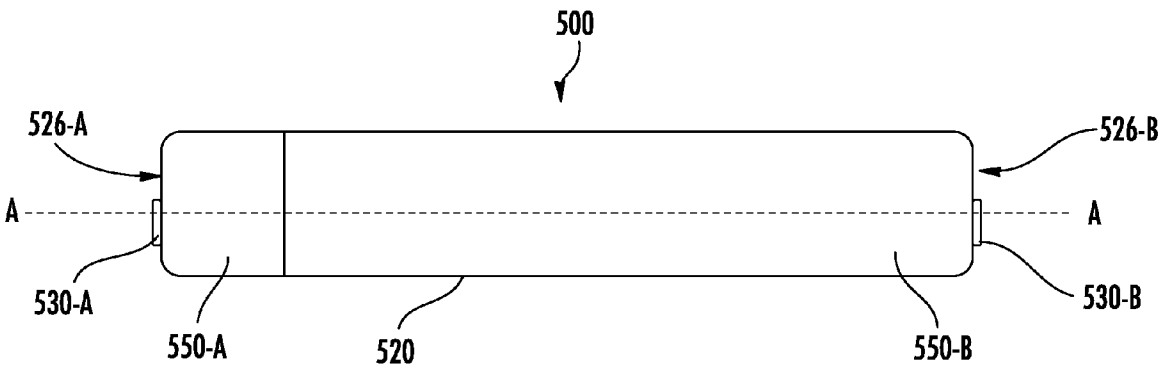
FIG. 5B illustrates a side view of the fuse shown in FIG. 5A.

FIG. 5B illustrates a side view of the assembled fuse 500 including the fuse body 520 with the ends 530-A and 530-B of the fusible element 530 extending from the fuse body 520 along the end surfaces 526-A and 526-B, respectively. The electroless plated first end termination 550-A and second end termination 550-B are located at the respective ends of fuse body 520 and extend over the first 526-A and second 526-B end faces as well as cover the insulated plugs 540-A and 540-B (not shown).

Figure 5C:
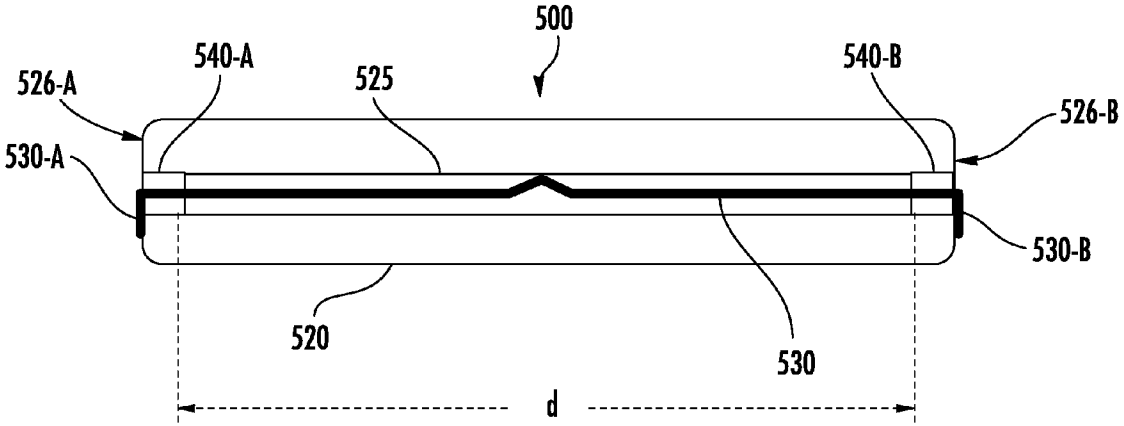
FIG. 5C illustrates a side cross-sectional view of the fuse shown in FIG. 5A taken along lines A-A shown in FIG. 5B.

FIG. 5C illustrates a cross-sectional view of the assembled fuse 500 taken along lines A-A shown in FIG. 5A. As can be seen, the fusible element 530 is disposed within the cavity 525 of the fuse body 20 and extends through the insulated plugs 540-A and 540-B with the end 530-A disposed on the end face 526-A, and the end 530-B disposed on the end face 526-B. In particular, the end 530-A of the fusible element 530 extends through the plug 540-A, and the end 530-B of the fusible element 530 extends through the plug 540-B. The end 530-A is crimped or bent to extend along the surface of the end face 526-A. Similarly, the end 530-B is crimped or bent to extend along the surface 526-B.

When an overcurrent condition occurs, the fusible element 530 melts which interrupts the circuit to which the fuse 500 is connected. When the fusible element 530 melts, an electric arc may form in a gap or arc channel that is created between the separated, un-melted portions of the fusible element 530 that remain within the cavity 525. The unmelted portions of the fusible element 530 continue to melt and recede from one another and the arc channel therebetween continues to grow until the voltage in the circuit is lower than that required to maintain the arc across the arc channel, at which point the arc is extinguished. The insulated plugs 540-A and 540-B serve to reduce this arc channel within the cavity 525 by decreasing the length "d" of the cavity 525 defined between the insulated plugs 540-A and 540-B relative to conventional fuses having no such insulated plugs, as well as by providing insulated seals at the longitudinal ends of the fuse body 520 which facilitates the interruption of fault currents more quickly than conventional fuse configurations. In addition, it is contemplated that the insulated plugs 540-A and 540-B can be formed of ceramic adhesive or other insulative materials that do not possess gas evolving properties. Therefore, when an overcurrent condition occurs and an electrical arc is generated in the cavity 525, the insulated plugs 540-A and 540-B do not emit gas into the cavity 525 which could otherwise feed the arc.

Figure 6:
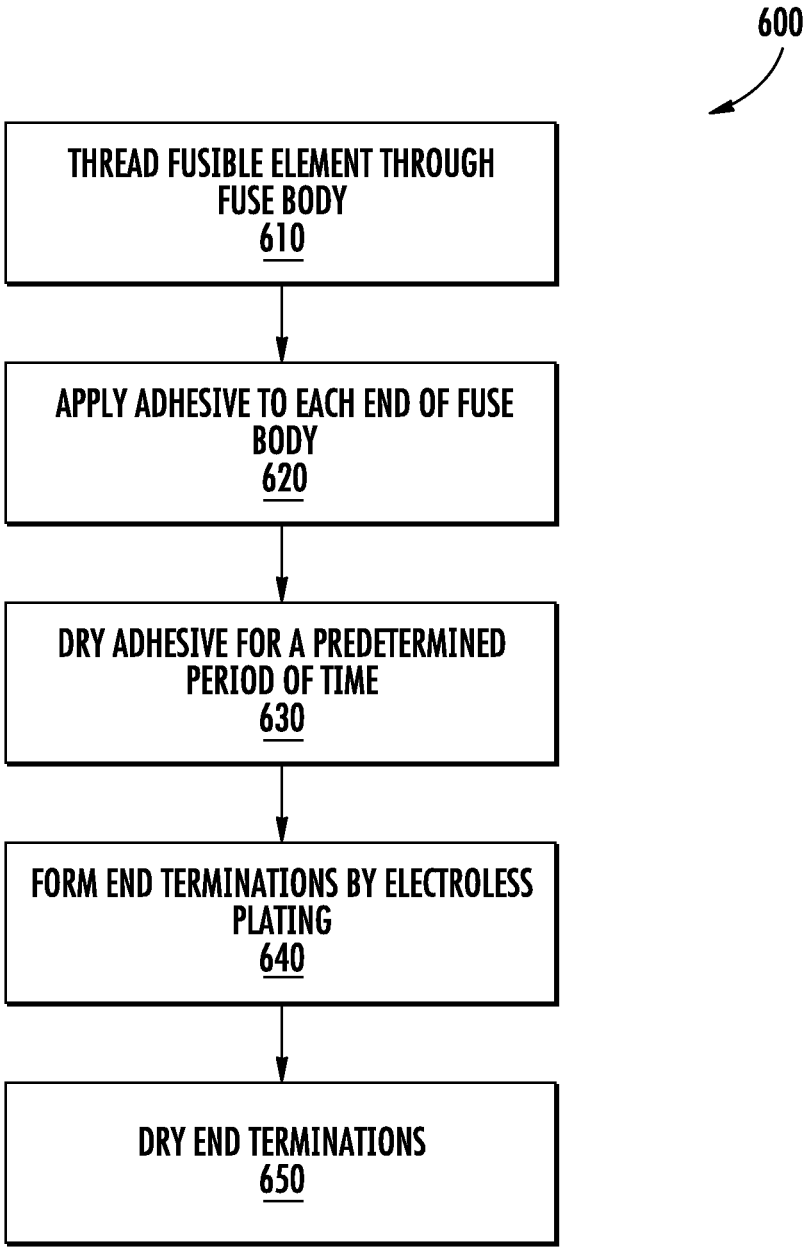
FIG. 6 illustrates a logic flow diagram in connection with the fuse shown in FIGS. 5A-5C.

FIG. 6 illustrates an embodiment of a logic flow 600 in connection with the fuse 500 shown in FIGS. 5A-5C. The fusible element 530, having a kinked portion 535 with holes formed therethrough, is threaded through the fuse body 520 at step 610. For example, the fusible element 530 is threaded through the fuse body 520 with the ends 530-A and 530-B being disposed on the end faces 526-A and 526-B. An insulative adhesive, such as a ceramic adhesive, is deposited within the cavity 525 at the longitudinal ends of fuse body 520 at step 620 to form respective adhesive plugs 540-A and 540-B. The adhesive adheres to the interior surface of the fuse body 520 and serves to close or seal the longitudinal ends of the cavity 525 with the ends 530-A and 530-B of the fusible element 530 extending through the adhesive plugs 540-A and 540-A. The adhesive is dried for a predetermined time period at step 630. The end terminations 550-A and 550-B, which may be formed, for example, of silver paste or an electrolessly deposited metal such as copper, are applied to each end of the fuse body 520 at step 640. The end terminations 550-A and 550-B are dried at step 650. The end terminations 550-A and 550-B may be plated with Nickel (Ni) and/or Tin (Sn) at step 660 to accommodate solderability of the fuse 500 to one or more electrical connections within a circuit.

Figure 7A:
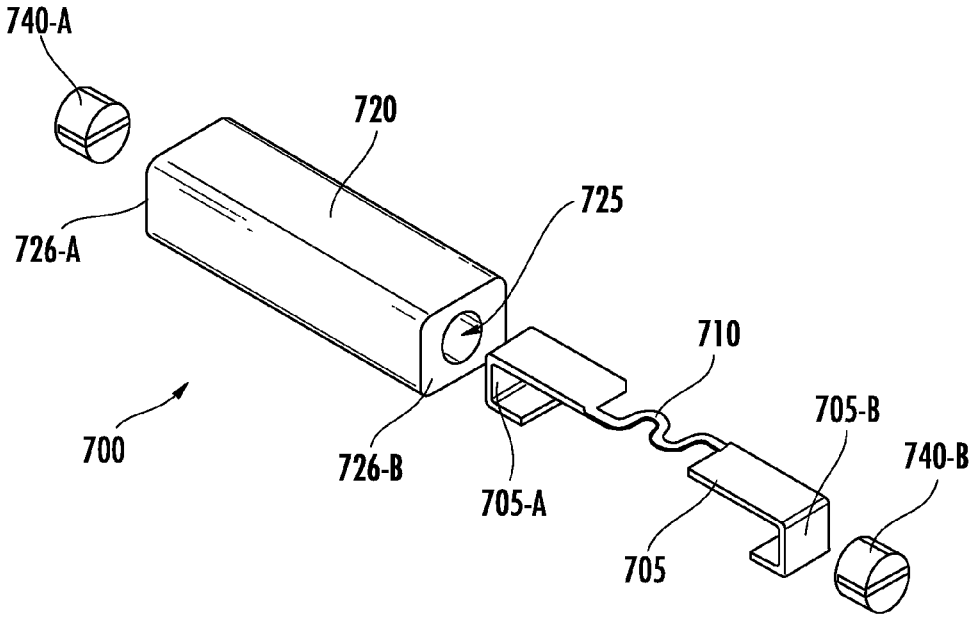
FIG. 7A illustrates a perspective exploded view of another alternative fuse embodiment in accordance with the present disclosure.
Figure 7B:
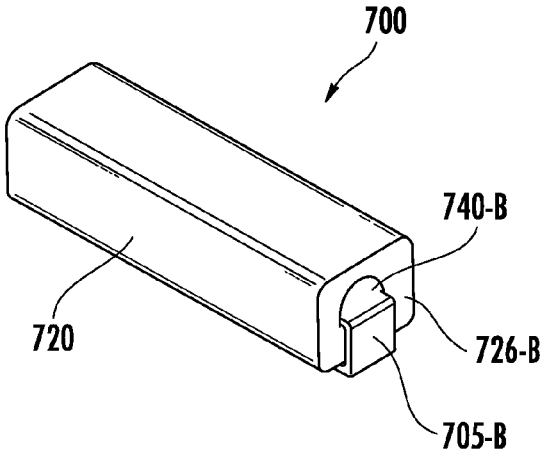
FIG. 7B illustrates a perspective view of the fuse shown in FIG. 7A.

FIGS. 7A and 7B illustrate an alternative fuse 700 in accordance with the present disclosure. As with the fuse 10 described above, the fuse 700 includes a fuse body 720 which defines a cavity 725 extending from a first end face 726-A to a second end face 726-B. The shape of the fuse body 720 can be, for example, rectangular, cylindrical, triangular, etc., with various cross-sectional configurations. The fuse body 720 may be formed from an electrically insulative material such as, for example, glass, ceramic, plastic, etc.

The fuse 10 further includes a fusible element 710 that may be a thinned portion of a relatively thicker conductor 705, such as may be formed by subjecting the conductor 705 to a conventional coining process. The fusible element 710 is configured to melt or otherwise create an open circuit under certain overcurrent conditions in the manner discussed above with respect to the fusible element 30. Unlike the fusible element 30, the fusible element 710 is formed with a corrugated, wave-like shape to relieve the element 710 from thermal stresses that could otherwise cause premature breakage of the element 710 during a thermal cycle. Moreover, the corrugation of the fusible element 710 results in nonlinearity of adjacent segments of the fusible element 710. That is, adjacent segments of the fusible element 710 are not coplanar. Thus, if the fusible element 710 begins to melt or separate at two or more points along its length, such as during the occurrence of an overcurrent condition, the electrical arcs that form at the points of separation are also not coplanar and are therefore less likely to combine and form larger electrical arcs. The detrimental effects of electrical arcing are thereby mitigated by the corrugated fusible element 710.

The conductor 705 and fusible element 710 are disposed within the cavity 725 which extends from the first end face 726-A of the fuse body 720 to the second end face 726-B. In particular, the conductor 705 has a first end 705-A which is bent or otherwise made contiguous with the respective end face 726-A of the fuse body 720 and a second end 705-B which is also bent or otherwise made contiguous with the respective end face 726-B of the fuse body 720.

Insulated plugs 740-A and 740-B are disposed within the cavity 725 at respective longitudinal ends of the fuse body 720. As described above with regard to the fuse 10, the insulated plugs 740-A and 740B may be formed of an insulative adhesive material, such as ceramic adhesive, that is deposited within the cavity 725 after the fusible element 710 is positioned within fuse body 720, with the ends 710-A and 710-B extending through the plugs 740-A and 740-B and disposed on the respective end faces 726-A and 726-B. Particularly, since the plug 740-A may be an adhesive applied to the interior of the cavity 725, the conductor 705 which is positioned within the fuse body 720, is surrounded by the adhesive that comprises the plug 740-A. In this manner, the end 705-A of the conductor 705 extends through the adhesive plug 740-A and also extends outside the fuse body 720. Similarly, since the plug 740-B may be made from an adhesive applied to the interior of the cavity 725, the conductor 705 which is positioned within fuse body 720 is surrounded by the adhesive that comprises the plug 740-B. In this manner, the end 705-B of the conductor 705 extends through the adhesive plug 740-B and also extends outside of the fuse body 720. Each of the ends 705-A and 705-B of the conductor 705 may be bent or crimped along the respective end surfaces 726-A and 726-B of the fuse body 720 as described above.

Unlike the fuses 10, 100, and 500 described above, the fuse 700 does not include end terminations at the first 726-A and second 726-B end faces of the fuse body 720 for providing electrical connections to external circuit elements. Instead, the relatively thicker portions of the conductor 705, located outside of the fuse body 720, provide direct connection to other circuit elements.

Figure 8A:
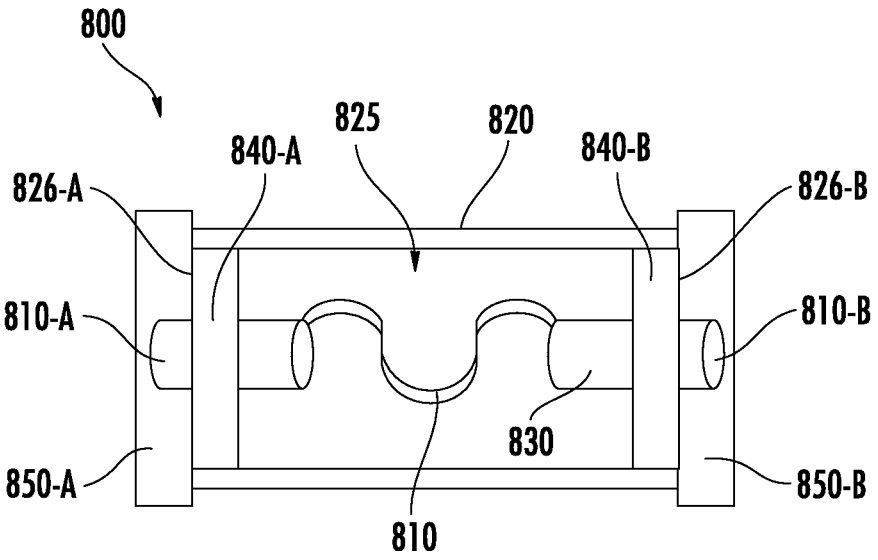
FIG. 8A illustrates a side cross sectional view of another alternative fuse embodiment in accordance with the present disclosure.
Figure 8B:
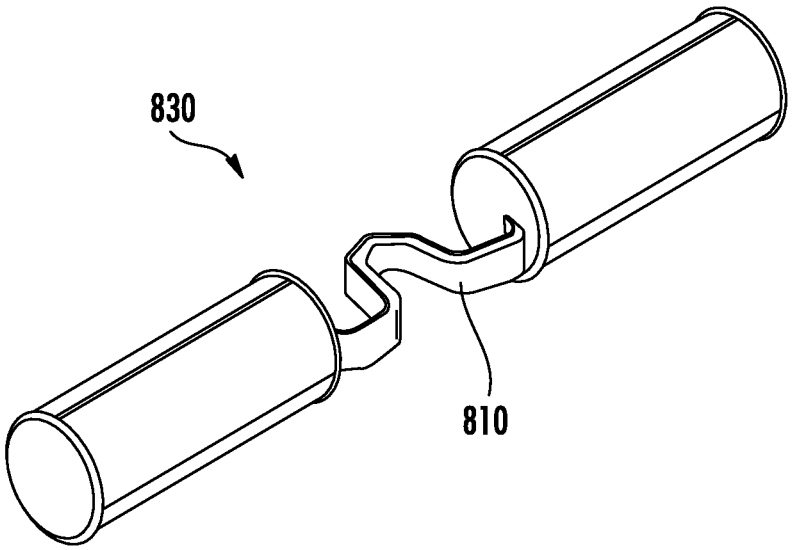
FIG. 8B illustrates a perspective view of the fuse element of the fuse shown in FIG. 8A

FIGS. 8A and 8B respectively illustrate an alternative fuse 800 and corresponding conductor 805 defining a fusible element 810 in accordance with the present disclosure. The fuse 800 includes a fuse body 820 which defines a cavity 825 extending from a first end face 826-A to a second end face 826-B. The conductor 805 is disposed within the cavity 825. The shape of the fuse body 820 can be, for example, rectangular, cylindrical, triangular, etc., with various cross-sectional configurations. The fuse body 820 may be formed from an electrically insulating material such as, for example, glass, ceramic, plastic, etc.

The fusible element 810 is a thinned portion of a relatively thicker conductor 805, such as may be formed by subjecting the conductor 805 to a conventional coining process. The fusible element 810 is configured to melt or otherwise create an open circuit under certain overcurrent conditions in the manner discussed above with respect to the fusible element 30. Like the fusible element 710 described above, the fusible element 810 is formed with a corrugated, wave-like shape to relieve the element 810 from thermal stress that could otherwise cause premature breakage of the element 810 during a thermal cycle. Moreover, the corrugation of the fusible element 810 results in nonlinearity of adjacent segments of the fusible element 810. That is, adjacent segments of the fusible element 810 are not coplanar. Thus, if the fusible element 810 begins to melt or separate at two or more points along its length, such as during the occurrence of an overcurrent condition, the electrical arcs that form at the points of separation are also not coplanar and are therefore less likely to combine and form larger electrical arcs. The detrimental effects of electrical arcing are thereby mitigated by the corrugated fusible element 810.

The fuse 800 also includes insulated plugs 840-A and 840-B which are disposed within the cavity 825 at respective longitudinal ends of the fuse body 820. The insulated plugs 840-A and 840-B may be formed of an insulating adhesive, such as ceramic adhesive, disposed in the cavity 825 to close or seal openings thereto at respective longitudinal ends of the fuse body 820. In particular, the insulated plugs 840-A and 840-B may be dispensed in the cavity 825 after the fusible element 810 is positioned within fuse body 820. The insulated plugs 840-A and 840-B may be positioned to allow respective, relatively thicker end portions 805-A and 805-B of the conductor 805 to be disposed through the plugs to allow the end portions 805-A and 805-B to extend longitudinally beyond the end surfaces 526-A and 526-B, respectively. Particularly, since the plug 840-A may be an adhesive applied to the cavity 825, the end portion 805-A, positioned within the fuse body 820, is surrounded by the adhesive that comprises the plug 840-A. In this manner, the end portion 805-A of the conductor 805 extends through the adhesive plug 540-A and also extends outside the fuse body 820. Similarly, since plug 840-B may be made from an adhesive applied to the cavity 825, the end portion 805-B, positioned within fuse body 820, is surrounded by the adhesive that comprises the plug 840-B. In this manner, the end portion 805-B of the conductor 805 extends through the adhesive plug 840-B and also extends outside of the fuse body 820.

The fuse 800 includes first 850-A and second 550-B end terminations located at the first 826-A and second 826-B end faces, respectively, of the fuse body 820 which also cover the insulated plugs 840-A and 840-B. In particular, the end termination 850-A is disposed on a respective end of the fuse body 820 and is in electrical contact with at least the end portion 805-A of the conductor 805 at the end face 826-A. Similarly, the end termination 850-B is disposed over a respective end of the fuse body 820 and is in electrical contact with at least the end portion 805-B of the conductor 805 at the end face 826-B. In this manner, a current path is defined between the end terminations 850-A and 850-B and the fusible element 810. The first and second end terminations 850-A and 850-B may be formed of an electrically conductive material, such as silver (Ag) paste or an electrolessly deposited metal such as copper (Cu), applied to the ends of the fuse body 820. The end terminations 850-A and 850-B may also be plated with nickel (Ni) and/or tin (Sn) to accommodate soldering of the fuse 800 to a circuit board or other electrical circuit connection.

Figure 9:
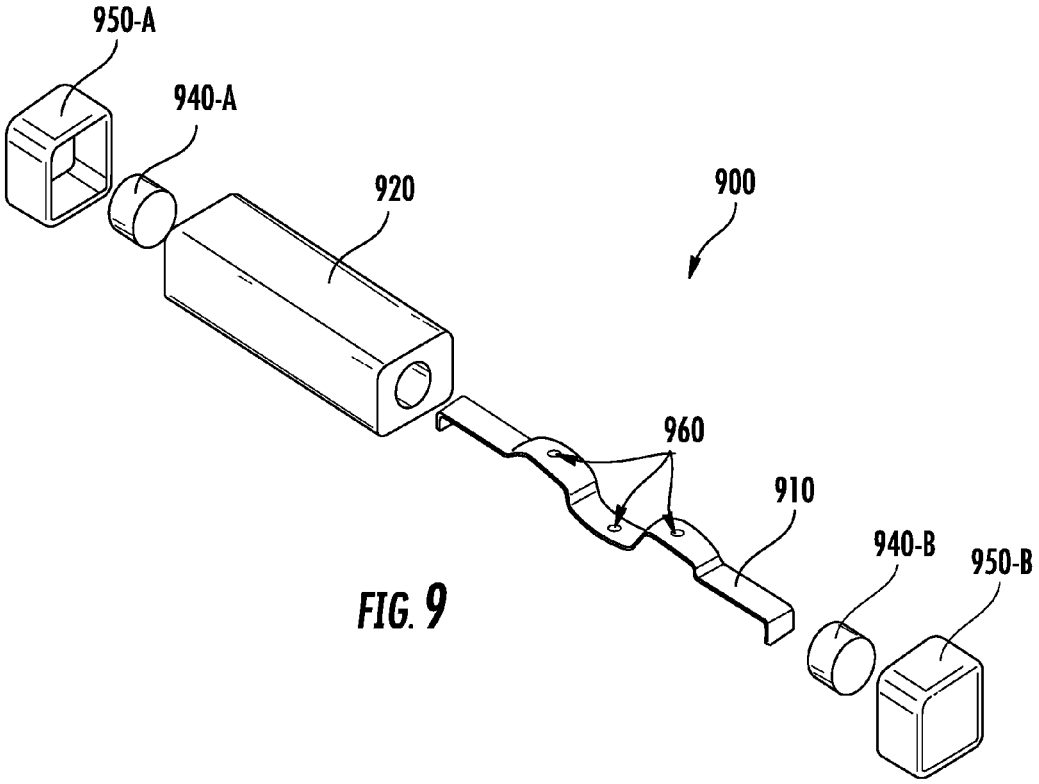
FIG. 9 illustrates an exploded perspective view of another alternative fuse embodiment in accordance with the present disclosure.

FIG. 9 illustrates an alternative fuse 900 in accordance with the present disclosure. The fuse 900 and method of making the same are substantially similar to the fuse 10 and the method of making fuse 10 as described above. Particularly, the fuse 900 includes a fusible element 910, a fuse body 920, insulated plugs 940-A and 940-B, and electroless plated terminations 950-A and 950-B that are disposed and interconnected in substantially the same manner as the fusible element 30, fuse body 20, insulated plugs 40-A and 40-B, and end terminations 50-A and 50-B of the fuse 10.

The fusible element 910 is configured to melt or otherwise create an open circuit under certain overcurrent conditions in the manner discussed above with respect to the fusible element 30. However, unlike the fusible element 30, the fusible element 910 of the fuse 900 is formed with a corrugated, wave-like shape, like fusible elements 710 and 810 described above, to relieve the element 910 from thermal stresses that could otherwise cause premature breakage of the element 910 during a thermal cycle. The fusible element 910 may also have one or more holes 960 formed therethrough to provide weak connection areas. Thus, if the fusible element 910 begins to melt or separate at two or more of the holes 960, such as during the occurrence of an overcurrent condition, the electrical arcs that form at the holes 960 are also not coplanar and are therefore less likely to combine and form larger electrical arcs. The detrimental effects of electrical arcing are thereby mitigated by the corrugated fusible element 910.

Figure 10A:
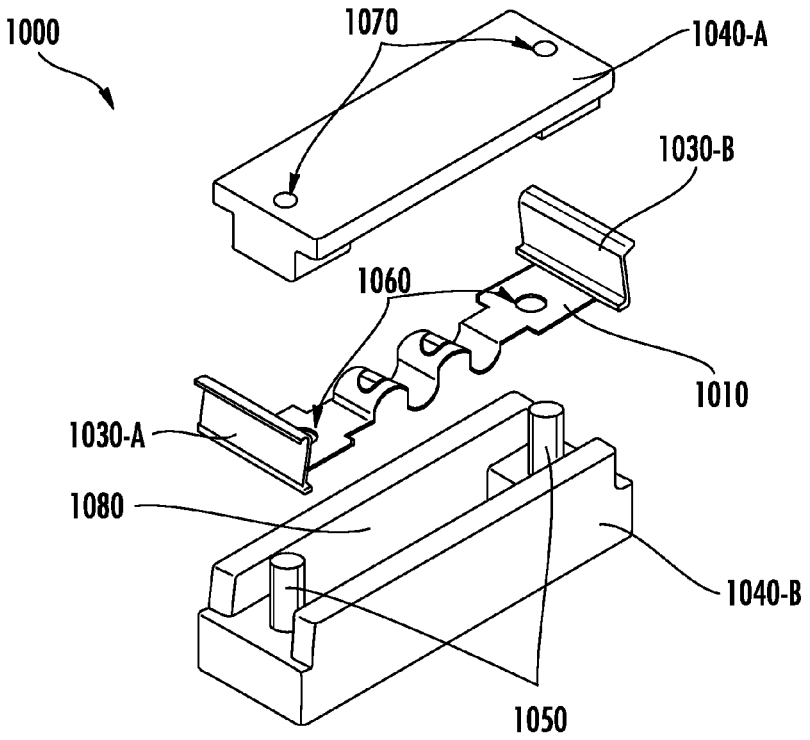
FIG. 10A illustrates an exploded perspective view of another alternative fuse embodiment in accordance with the present disclosure.
Figure 10B:
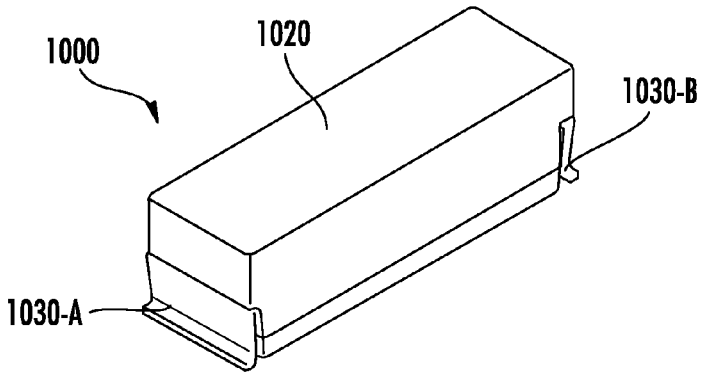
FIG. 10B illustrates a perspective view of the fuse embodiment shown in FIG. 10A.

FIGS. 10A and 10B illustrate yet another alternative fuse 1000 in accordance with the present disclosure. The fuse 1000 is substantially similar to the fuse 900 described above, and similarly includes a fuse body 1020 and a corrugated, wave-shaped fuse element 1010 having holes formed therethrough to provide the element 1010 with weak connection areas and to mitigate the formation of electrical arcs as described above. However, unlike the fuse 900, the fuse 1000 does not include insulated plugs or separate, electroless plate terminations. Instead, the fuse 1000 includes a fuse element 1010 that terminates at both ends in contiguous termination plates 1030-A and 1030-B. The fuse 1000 further includes a two-piece fuse body 1020 having generally U-shaped base 1040-A and cover 1040-B portions that are configured to fit together to form an enclosure. The base portion 1040-A may include a pair of longitudinally-spaced bosses 1050 extending upwardly from an interior surface thereof, and the fuse element 1010 and cover portion 1040-B may include correspondingly positioned pairs of holes 1060 and 1070 formed therethrough for receiving the bosses 1050 as further described below. The base 1040-A and cover 1040-B portions may be formed of an electrically insulative material such as glass, ceramic, plastic, etc.

When the fuse 1000 is operatively assembled as shown in FIG. 10B, the fuse element 1010 is sandwiched between the base portion 1040-A and the cover portion 1040-B and fits within a cavity or channel 1080 defined therebetween, with the bosses 1050 extending upwardly through the holes 1060 and 1070. The bosses 1050 may thereafter be heat staked in order to achieve an interference fit between the bosses 1050 and the cover portion 1040-B, thereby firmly securing the base portion 1040-A, the fuse element 1010, and the cover portion 1040-B together. With the fuse 1000 assembled thusly, the termination plates 1030-A and 1030-B of the fuse element 1010 protrude from the fuse 1020 and flatly abut respective ends of the fuse body 1020. The termination plates 1030-A and 1030-B thereby accommodate soldering of the fuse 1000 to a circuit board or other electrical circuit connection. It will be appreciated that many other means for fastening the base portion 1040-A and the cover portion 1040-B of the fuse body 1020 together may be substituted for the heat-staked bosses 1050 described above. For example, the base portion 1040-A and the cover portion 1040-B may be fastened together via snap fit or by using mechanical fasteners or adhesives.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

The invention claimed is:

1. A fuse comprising:

a fuse body formed of electrically insulative material defining a cavity extending longitudinally from a first end of the fuse body to a second end of the fuse body;

a fusible element disposed within the cavity and extending from a first end face of the fuse body at the first end to a second end face of the fuse body at the second end;

first and second insulated plugs bonded to an interior surface of the fuse body at the first and second ends, respectively, wherein the first and second insulated plugs seal respective ends of the cavity;

wherein a first portion of the fusible element proximate the first end of the fuse body extends between the first insulated plug and the interior surface of the fuse body with a first end of the fusible element protruding from the cavity, the first end of the fusible element engaging and terminating at the first end face of the fuse body;

wherein a second portion of the fusible element proximate the second end of the fuse body extends between the second insulated plug and the interior surface of the fuse body with a second end of the fusible element protruding from the cavity, the second end of the fusible element engaging and terminating at the second end face of the fuse body;

first and second end terminations covering the first and second ends of the fuse body, respectively, the first end termination being in electrical contact with the fusible element at the first end face and the second end termination being in electrical contact with the fusible element at the second end face; and first and second metalized coatings disposed on the first and second end faces of the fuse body, respectively, in electrical contact with respective ends of the fusible element for facilitating electrical connections between the fusible element and the first and second end terminations;

wherein the first and second insulted plugs extend through the first and second metalized coatings, respectively, and engage the first and second end terminations, respectively.

2. The fuse of claim 1, wherein the fusible element extends diagonally within the cavity from the first end of the fuse body to the second end of the fuse body.

3. The fuse of claim 1, wherein the first and second insulated plugs are formed of an insulative adhesive material.

4. The fuse of claim 3, wherein the insulative adhesive material is a ceramic adhesive.

5. The fuse of claim 1, wherein the first and second insulated plugs are formed of an insulative adhesive material that does not exhibit gas evolving properties when the first and second insulated plugs are exposed to an electrical arc condition within the fuse body.

6. The fuse of claim 1, wherein the first and second end terminations are formed of an electrically conductive paste.

7. The fuse of claim 6, wherein the electrically conductive paste is a silver paste.

8. The fuse of claim 1, wherein the first and second end terminations are formed of electrolessly deposited metal.

9. The fuse of claim 1, wherein the first and second end terminations are each covered with a conductive metallic material.

* * * * *